US012638251B2

(12) United States Patent
Vachon

(10) Patent No.: US 12,638,251 B2
(45) Date of Patent: May 26, 2026

(54) HEATING AND COOLING SYSTEM USING MECHANICAL TRANSFER OF ENCAPSULATED PHASE CHANGE MATERIALS

(71) Applicant: TRIGO ENERGIES INC., Trois-Rivières (CA)

(72) Inventor: Christian Vachon, Magog (CA)

(73) Assignee: 9494-2851 QUÉBEC INC., Trois-Rivieres (CA)

( * ) Notice: Subject to any disclaimer, the term of this patent is extended or adjusted under 35 U.S.C. 154(b) by 146 days.

(21) Appl. No.: 18/599,756

(22) Filed: Mar. 8, 2024

(65) Prior Publication Data

US 2024/0302109 A1 Sep. 12, 2024

Related U.S. Application Data

(60) Provisional application No. 63/488,978, filed on Mar. 8, 2023.

(51) Int. Cl.
*F28D 20/02* (2006.01)
*F28D 20/00* (2006.01)

(52) U.S. Cl.
CPC ..... *F28D 20/028* (2013.01); *F28D 20/0034* (2013.01); *F28D 20/023* (2013.01); *F28D 2020/0017* (2013.01); *F28D 2020/0082* (2013.01)

(58) Field of Classification Search
CPC ..... F28C 3/14; F28D 20/028
See application file for complete search history.

(56) References Cited

U.S. PATENT DOCUMENTS

| | | | | |
|---|---|---|---|---|
| 2,432,520 | A * | 12/1947 | Ferro, Jr. | F28C 3/14 422/198 |
| 2,530,274 | A * | 11/1950 | Weber | F28C 3/14 422/216 |
| 2,616,678 | A * | 11/1952 | Grossman | F28C 3/14 432/27 |
| 4,136,668 | A * | 1/1979 | Davis | F24S 60/00 126/633 |
| 4,361,182 | A * | 11/1982 | Michalak | F28D 19/041 165/8 |
| 4,807,696 | A | 2/1989 | Colvin et al. | |
| 8,201,615 | B2 | 6/2012 | Soukhojak et al. | |
| 2013/0068215 | A1 | 3/2013 | Neuhaeuser et al. | |

FOREIGN PATENT DOCUMENTS

| | | | | |
|---|---|---|---|---|
| CN | 113720188 A | * | 11/2021 | F28D 20/003 |
| DE | 102012019791 A1 | * | 4/2014 | F28D 20/0056 |

* cited by examiner

*Primary Examiner* — Eric S Ruppert
(74) *Attorney, Agent, or Firm* — NORTON ROSE FULBRIGHT CANADA LLP

(57) ABSTRACT

A heat transfer system comprises a solid-liquid phase change material (PCM) encapsulated in a plurality of capsules movable through a closed loop circuit by a transfer mechanism.

18 Claims, 11 Drawing Sheets

Interior cylinder
$E_2$
Exterior cylinder
$E_1$
Fan (22)
Fan (20)
14
14a
14b
16
18
12
12a
12b
16
Conveyor motors
$A_1$
$A_2$

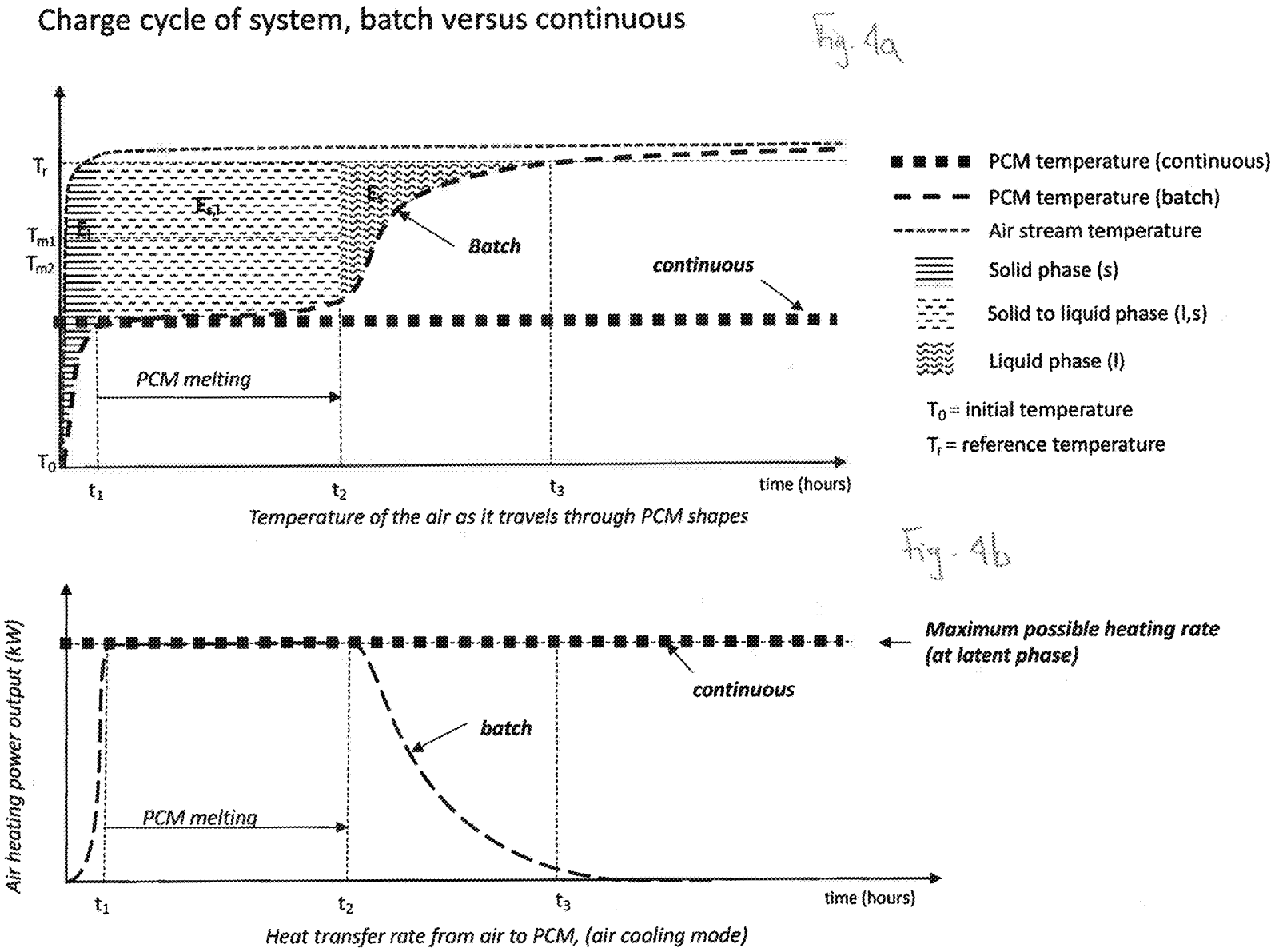
Charge cycle of system, batch versus continuous
Fig. 4a
PCM temperature (continuous)
PCM temperature (batch)
Air stream temperature
Solid phase (s)
Solid to liquid phase (l,s)
Liquid phase (l)
$T_0$ = initial temperature
$T_r$ = reference temperature
$T_r$
$T_{m1}$
$T_{m2}$
$T_0$
$t_1$
$t_2$
$t_3$
time (hours)
Batch
continuous
PCM melting
Temperature of the air as it travels through PCM shapes
Fig. 4b
Maximum possible heating rate (at latent phase)
Air heating power output (kW)
time (hours)
continuous
batch
PCM melting
Heat transfer rate from air to PCM, (air cooling mode)

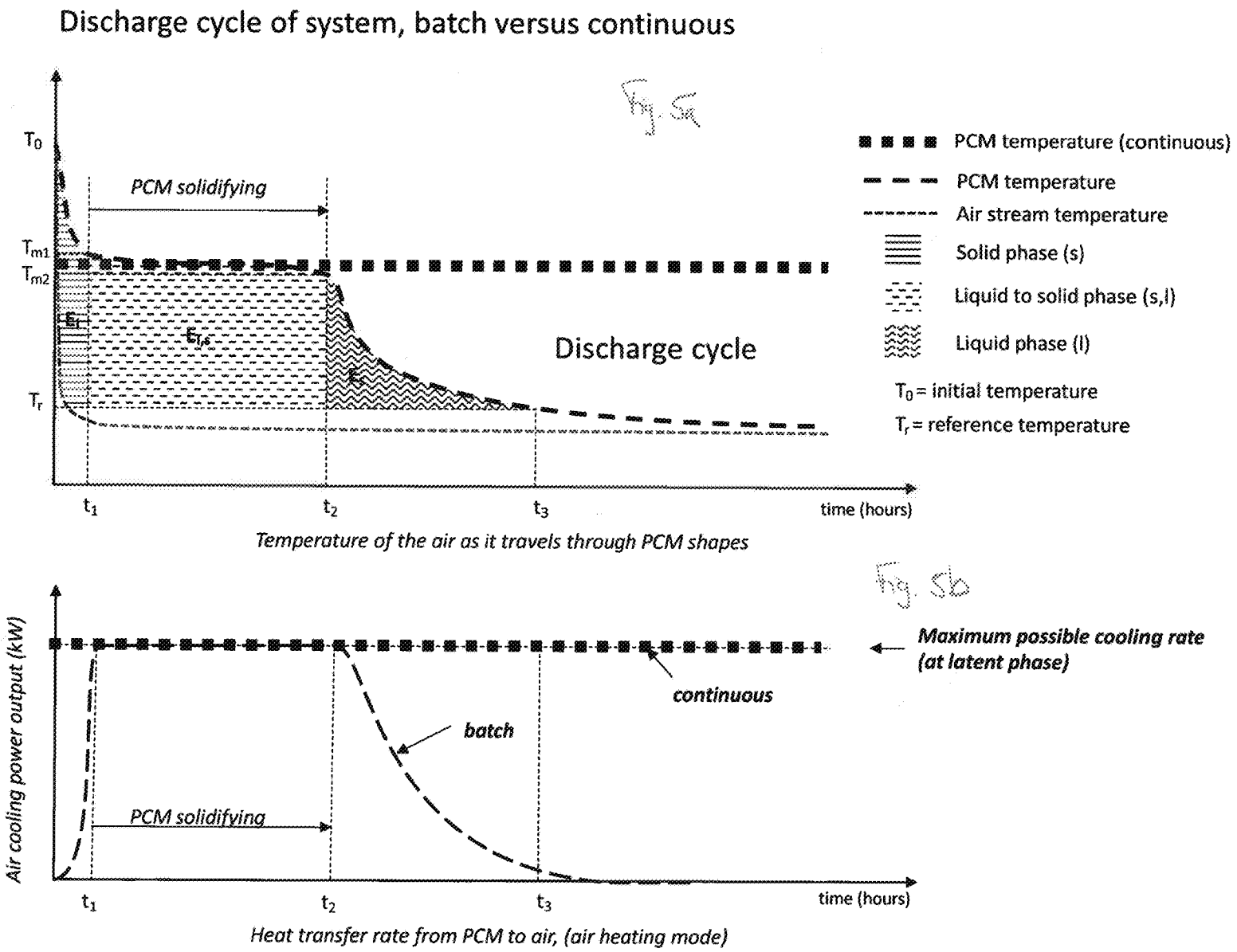
Discharge cycle of system, batch versus continuous
Fig. 5a
PCM temperature (continuous)
PCM temperature
Air stream temperature
Solid phase (s)
Liquid to solid phase (s,l)
Liquid phase (l)
$T_0$ = initial temperature
$T_r$ = reference temperature
Discharge cycle
PCM solidifying
$T_0$
$T_{m1}$
$T_{m2}$
$T_r$
$t_1$
$t_2$
$t_3$
time (hours)
Temperature of the air as it travels through PCM shapes
Fig. 5b
Maximum possible cooling rate (at latent phase)
continuous
batch
PCM solidifying
$t_1$
$t_2$
$t_3$
time (hours)
Heat transfer rate from PCM to air, (air heating mode)
Air cooling power output (kW)

Overall system design with main parts and reservoir of PCM capsules

PCM in motion:
High latent/total heat ratio, constant
Inexistent or low sensible/total heat ratio
Air $T_{out}$ = 27C
Air $T_{in}$ = 20°C
31°C
29°C
Constant PCM temperature profile
Time (h)
0
1
2
3
4
5
6

Useful discharge power (kW) @ T=27°C
max
Useful discharged energy (kWh)
Constant useful energy discharge power
Time (h)
0
1
2
3
4
5
6

HEATING AND COOLING SYSTEM USING MECHANICAL TRANSFER OF ENCAPSULATED PHASE CHANGE MATERIALS

CROSS-REFERENCE TO RELATED APPLICATIONS

This application claims priority on Provisional U.S. Application No. 63/488,978 filed Mar. 8, 2023, the entire content of which is incorporated by reference herein.

TECHNICAL FIELD

The application relates generally to a heat transfer system suitable for cooling and/or heating an enclosed space or a process.

BACKGROUND OF THE ART

Phase change materials (PCMs) are often used as thermal management solutions. Usually PCMs are physically fixed within a wall, a ceiling, a woven fabric, or a device of any kind. PCMs do their work of cooling/heating devices by melting and solidifying wherever they are. The main disadvantage of being fixed/stationary is that once the PCM is fully melted or solidified, it looses some of its effectiveness. Improvements are thus desirable.

SUMMARY

According to one aspect of the present disclosure, there is provided a heat transfer system wherein a phase change material (PCM) is encapsulated inside a plurality of units/capsules and wherein transfer means are provided to move the PCM units/capsules between a cold environment and a warm environment.

According to another aspect, the PCM has a melting or phase change temperature set between a first temperature of the cold environment and a second temperature of the warm environment.

In another aspect, there is provided a heating and cooling system comprising a first container and a second container, the first container located inside an enclosed space to be heated or cooled, the second container located outside of the enclosed space. Both the first and second containers contain a plurality of encapsulated phase change material (PCM) units or capsules. Transfer means, such as endless screws, conveyor belts, gravity chutes, feeders etc., are provided between the first and second containers to physically move the plurality of individually encapsulated PCM units between the first and second containers. Various fluids, such as air and water to name a few, may be used to cool and/or heat the PCM capsules. In air-based applications, air moving means are provided to cause first and second air streams to respectively flow through the first and second containers in between the PCM capsules contained therein, so that the encapsulated PCM capsules in the first and second containers are exposed to respective air streams.

According to another aspect, the system may further include a PCM capsule reservoir, ready to feed the first and/or the second container, whichever is the one that has priority based on thermal demand, whether it be for coolth or warmth.

In another aspect, while within their respective containers, the PCM capsules are exposed to heat or cold for a given period to absorb thermal energy. A fan or the like may move air through each of the first and second containers, so that the plurality of PCM capsules are exposed to the passing air by forced convection and attain the temperature of their respective air streams. Upon activation of transfer means, the PCM units are displaced physically from one container to the other. By doing so, thermal energy is therefore transferred from the first container to the second container and vice versa. In heating applications, the heat is transferred from the exterior air stream (warm) to the interior (i.e., the cold enclosed space to be heated). In air-conditioning applications, heat is transferred from the interior air stream (i.e., the warm enclosed space to be cooled) to the exterior air stream (cold).

According to another aspect, the system has a controller configured so that the heat transfer between warm and cold sources occurs during the phase-change transformation of the capsules, e.g., while the PCM core of the capsules is melting and/or solidifying. To this end, the controller may be operatively connected to the capsules transfer means and to the air moving means for regulating the movement of the capsules from one environment to the other as well as the flow of air or other heat transfer fluid passing therearound. The transfer rate of the capsules and the flow rate of the heat transfer fluid may be adjusted according to control commands generated by the controller so as to take advantage of the latent heat available during the phase-change transformation of the PCM capsules.

According to another aspect, each encapsulated PCM unit comprises a PCM or storage material core in liquid and/or solid form enclosed within an outer shell. The PCM/storage material is selected to have a melting point temperature set between the respective temperatures of the cold and the hot sources/environments, so that the PCM changes phase (liquid-to-solid or solid-to-liquid) when exposed to the different sources/environments. This contributes to ensure that a maximum amount of thermal energy is transferred between both environments, even though the temperature difference between them can be relatively small. In operation, the encapsulated PCM material is exposed to a heat source to capture (store) heat. It is then transferred/moved to a cold source where the stored heat is discharged. The plurality of encapsulated PCM units travel through mechanical means or the like between the hot and cold sources to supply the desired heating or cooling effect. Heat moves from the cold side to the warm side, so depending on whether the system is being used in cooling or heating mode, the warm and cold PCM units will be travelling in one direction, and then in the opposite direction when the system switches from one mode to the other.

According to another further aspect, in a heating mode of the system, the warm PCM units (filled with melted PCM) will be travelling from an outdoor container (e.g., the first container) to an indoor container (e.g., the second container located in the enclosed space or process to be heated), and the cold PCM units (with solid PCM) will be traveling from the indoor container to the outdoor container. In the cooling mode of the system, the warm PCM units (filled with melted PCM) will be travelling from the indoor container to the outdoor container, and the cold PCM units (with solid PCM) will be traveling from the outdoor container to the indoor container.

In a further aspect, the shape and configuration of the encapsulated PCM units is selected to facilitate handling and transfer of the PCM units/capsules from one container to the other. For instance, the PCM units/capsules can be provided in the form of spherical balls, small cylinders, pouches, pellets or any other form that can facilitate conveying of the individual units by mechanical transfer means between the first and second containers. The outer shell of each PCM unit can be solid or soft. The outer shell is made out of thermally conductive and permeable material; and it should be durable enough to withstand frequent changes in the storage material's volume as phase changes occur.

According to a still further aspect, there is provided an apparatus comprising a first container located in a cold environment, a second container located in a warm environment, a plurality of encapsulated solid-liquid phase change material (PCM) units inside the first and second containers, the plurality of encapsulated solid-liquid PCM units in heat exchange relationship with respective fluid streams flowing through the first and second containers, and transfer means for physically moving the encapsulated solid-liquid PCM units from the first container to the second container and vice versa. By moving the PCM units from one container to the other and exposing the PCM units to fluid streams at different temperatures, thermal energy is transferred from one environment to the other.

According to a still further aspect, there is provided a heat transfer system comprising: a first container and a second container, the first container located in a first environment, the second container located in a second environment, the first environment having a first temperature, the second environment having a second temperature, the first and second temperatures being different, the first and second containers each containing a plurality of capsules having a phase change material (PCM) core encapsulated in a thermally conductive outer shell, the PCM core having a phase change temperature selected between the first and second temperatures; a first fluid circuit for circulating a first fluid in heat exchange relationship with the plurality of capsules inside the first container; a second fluid circuit for circulating a second fluid in heat exchange relationship with the plurality of capsules inside the second container; transfer means between the first and second containers for transferring the plurality of capsules from the first container to the second container and vice versa; and a controller operatively connected to the transfer means and the first and second fluid circuits, the controller configured for controlling a flow rate of the plurality of capsules between the first and the second containers as a function of a temperature and a flow rate of the first fluid through the first container and a temperature and a flow rate of the second fluid through the second container.

According to a still further aspect, there is provided a heat transfer system comprising: a first container; a second container remote from the first container; a solid-liquid phase change material (PCM) having a phase change temperature selected between a first temperature of the first container and a second temperature of the second container, an entirety of the PCM encapsulated in individual capsules; a transfer mechanism for transferring the individual capsules from the first container to the second container and vice versa; a first heat transfer fluid circuit for directing a first heat transfer fluid through the first container, the first heat transfer fluid in heat exchange relationship with the individual capsules inside the first container; and a second heat transfer fluid circuit for directing a second heat transfer fluid through the second container, the second heat transfer fluid in heat exchange relationship with the individual capsules inside the second container.

DESCRIPTION OF THE DRAWINGS

Reference is now made to the accompanying figures in which:

FIGS. 4*a* and 4*b* graphically illustrate some of the operational parameters of a continuous/dynamic system where the PCM is in motion and a conventional static/batch system during a heat charge cycle;

FIGS. 5*a* and 5*b* graphically illustrate some of the operational parameters of a continuous/dynamic system where the PCM is in motion or not: and a conventional static/batch system during a heat discharge cycle;

DETAILED DESCRIPTION

Figure 1:
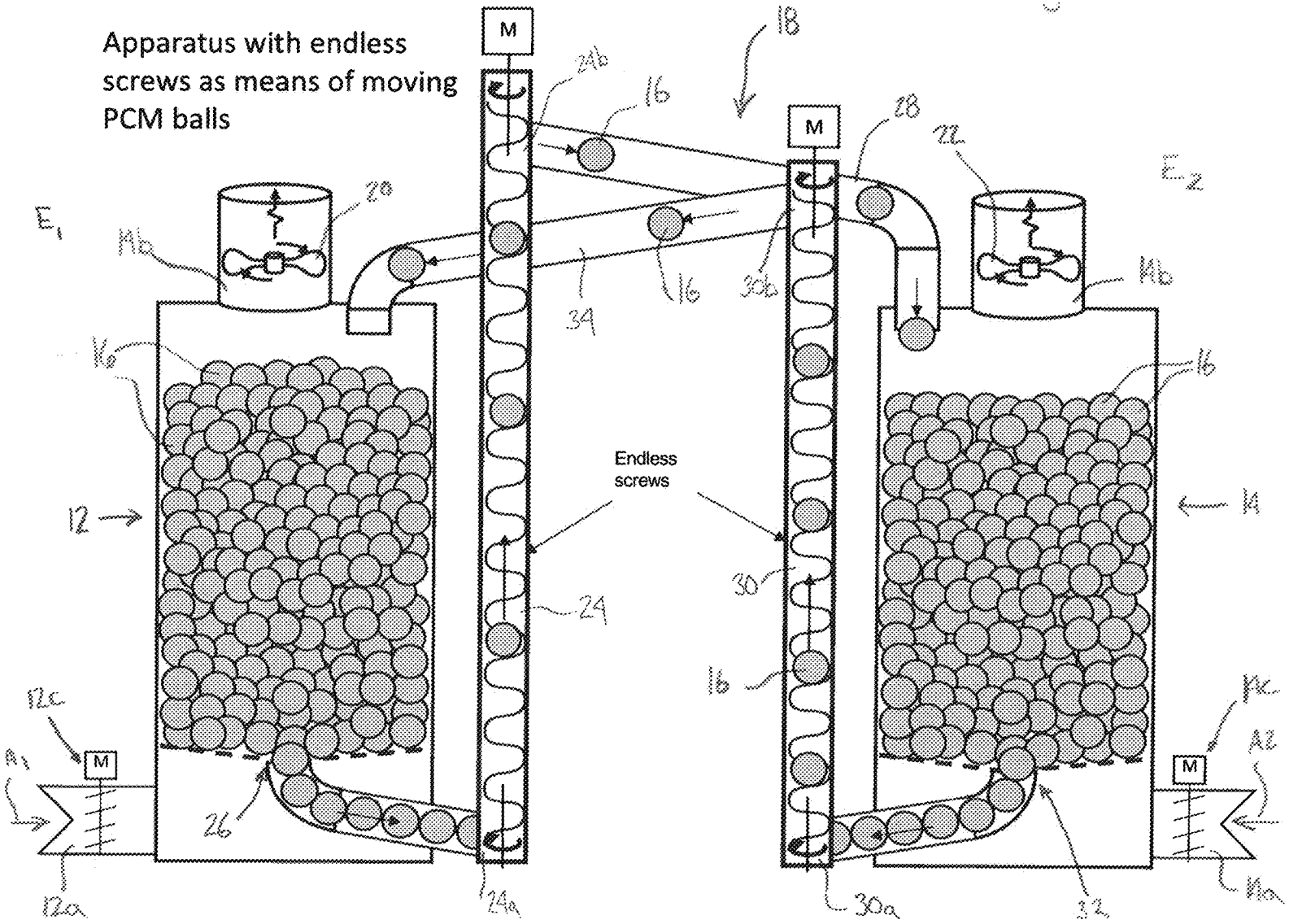
FIG. 1 is a schematic view of a heat transfer system including PCM capsules/units physically movable between two different environments.

FIG. 1 illustrates an embodiment of a heat transfer system suitable for use as a heating and cooling system 10 for heating or cooling an enclosed space (e.g., a building room) or an industry process. As will be seen hereinafter, the system 10 is configured to transfer heat from one place to another by moving encapsulated phase change material (PCM) between different environments.

PCMs are materials that absorb and release heat energy when they change phase. The thermal energy absorbed or released by the material as the phase change occurs, for example solid to liquid, is known as latent heat. That is heat which flows to or from the material without a change in the material temperature while phase change occurs. Such latent heat storage can be more efficient than sensible heat storage (i.e., heat energy stored in a substance as a result of an increase in its temperature) because it requires a smaller temperature difference between the storage and releasing functions. As will be seen hereinafter, the system is configured to maintain the PCM in the heat latent phase.

Figure 3:
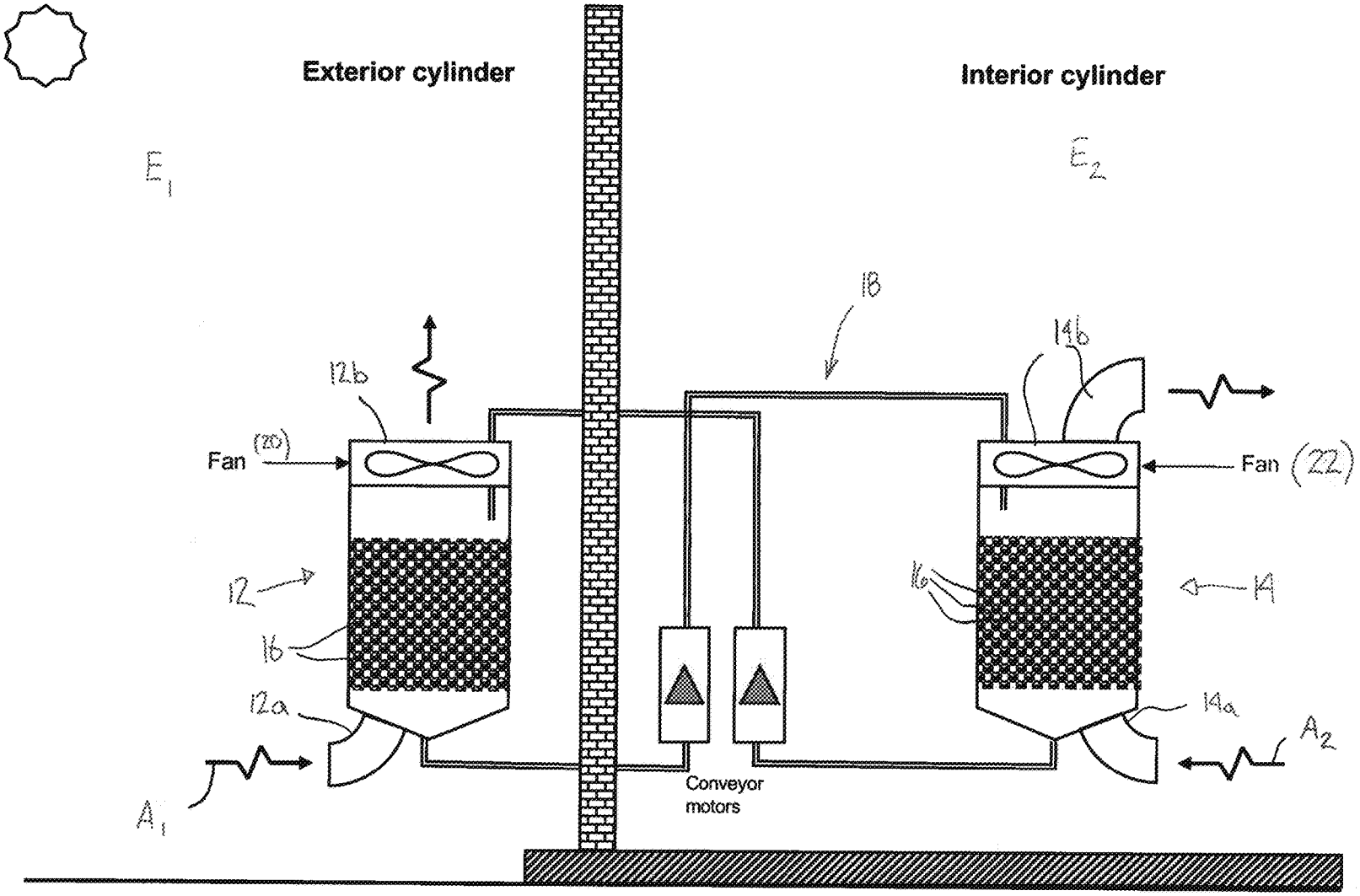
FIG. 3 illustrates one possible application of the system, wherein the first container is an outdoor container and the second container is an indoor container.

The system 10 generally comprises a first container 12 and a second container 14. According to one embodiment, the containers 12, 14 have a cylindrical shape. However, it is understood that other shapes and configurations are possible. The first and second containers 12, 14 are disposed in different environments E1, E2. For instance, as shown in FIG. 3, the first container 12 can be an outdoor container disposed outside a building, whereas the second container 14 can be an indoor container disposed in an enclosed space (e.g., a building room) to be heated or cooled. The system 10 further comprises a solid-liquid phase change material (PCM). In some embodiment, the entirety of the PCM is encapsulated in small units or capsules 16 adapted to be received in bulk in the containers 12, 14. A transfer mechanism 18 is provided for physically transferring/moving the individual PCM units or capsules 16 from the first container 12 to the second container 14 and from the second container 14 to the first container 12 in a closed loop-fashion. Such a fully encapsulated PCM can be moved between the containers 12, 14 irrespective of the PCM being in a solid state or a liquid state inside the individual capsules. This is not possible in system in which some of the PCM is not encapsulated. First and second heat transfer fluid circuits are respectively provided for circulating a first and a second fluid through the first and second containers. In some embodiments, air is used for the first and second fluids. The heat transfer fluid (e.g., air) is circulated in heat exchange relationship with the PCM units/capsules 16 inside the containers 12, 14 in order to carry heat to or way from the PCM capsules 16. The containers 12, 14 may be made of metal, polymer or other suitable materials to contain the PCM capsules 16. The containers 12, 14 may be thermally insulated to minimize thermal losses between the heat charging and heat discharging cycles. The distance between containers 12, 14 should be as short as possible to minimize thermal losses between containers, and to minimize hardware costs.

For air-based systems (i.e., systems in which air is circulated in between the PCM capsules 16 inside the containers 12, 14), the first and second fluid circuit are provided with air moving means, such as fans 20, 22, for circulating air in heat exchange relationship with the PCM capsules 16 inside the first and second containers 12, 14. To that end, each container 12, 14 has at least one air inlet 12*a*, 14*a* and at least one air outlet 12*b*, 14*b*. The air inlets 12*a*, 14*a* and air outlets 12*b*, 14*b* can take various forms. For instance, the container walls can be perforated to provide a plurality of holes/ports for allowing air to flow into and out of the containers 12, 14. According to some embodiments, each of the containers 12, 14 includes a single air inlet and a single air outlet. The air inlets and the air outlets are suitably disposed on the containers 12, 14 to maximize the exposure of the PCM units/capsules 16 to the first and second air streams A1, A2 (FIG. 3) respectively drawn through the first and second containers 12, 14. For instance, the air inlets 12*a*, 14*a* could be provided at the bottom of the containers 12, 14 and the air outlets 12*b*, 14*b* could be provided at the top of the containers 12, 14. The air may be circulated in counter flow to the flow of PCM capsules 16 through the system to improve heat exchange therebetween. The first and second fluid circuits can include motorized valves 12*c*, 14*c* or the like to selectively close and open the air inlets 12*a*, 14*a*. The fans 20, 22 and/or the valves 12*c*, 14*c* can be operatively connected to a controller (not shown) to adjust the airflows A1, A2 passing though the PCM capsules 16 in the containers 12, 14. The controller can operate the fans 20, 22 and/or the valves 12*c*, 14*c* to maximize the heat transfer between the sources of airflows A1, A2 and the PCM units/capsules 16. Sensors may be provided in the fluid circuits to measure operation parameters such as temperature, pressure, flow rate etc. The sensors are operatively connected to the controller. The controller is configured to receive and process the signals received from the sensors to operate the fans 20, 22, the valves 12*c*, 14*c* and the capsule transfer mechanism 18.

The use of air as the heat transfer fluid is advantageous in that leaks are much less critical in air-based systems than liquid-based systems. Also, most existing heating, ventilation, and air conditioning (HVAC) systems in North America are air-based, which may be advantageous from a retrofit point of view. Furthermore, air offers no chance of overheating or freezing. Air is also cheap and readily available. However, it is understood that other heat transfer fluids (e.g., water) could be used to carry heat to and away from the PCM capsules 16.

Each encapsulated PCM unit/capsule 16 generally comprises a solid-liquid PCM core encapsulated in a thin outer shell. The PCM core is selected to be subject to liquid-to-solid and solid-to-liquid phase changes within the temperature ranges prevailing in the first and second environments E1, E2. The encapsulated material changes phase from solid to liquid to absorb heat and from liquid to solid to give off heat. According to some embodiments, the PCM core is selected to have a melting temperature between a first temperature of the first environment E1 (e.g., the cold environment) and a second temperature of the second environment E2 (e.g., the warm environment) so that the solid-liquid phase change material changes phases when exposed to the first and second environments E1, E2, thereby providing for a maximum amount of thermal energy transferred between both environments, even though the temperature difference between the environments E1, E2 can be relatively small.

The outer shell of each PCM unit 16 can be solid or soft. The outer shell is made of a heat conducting material that is suitable for containing the PCM in both its liquid and its solid phase. The outer shell material should be durable enough to withstand frequent changes in the storage material's volume as phase changes occur. For instance, the outer shell could be made out of a metallic material, such as aluminium. Alternatively, the PCM core could be encapsulated in a polymer material, less conductive but cheaper to produce, or any other materials suitable to contain PCM and allow for heat transfer.

As shown in FIG. 1, the plurality of PCM capsules 16 may be provided in the form of individual balls or spherical units for easy handling. Spherical shapes are advantageous in terms of volume-to-surface ratio and are easy to handle with transfer means, such as belts or screws conveyors. Also, when packed into a container, spheres of equal diameters are always packed with the same volumetric density, that is, with constant air-PCM volume ratio at any locations within the container. The shape of the capsules 16 should provide for interstices or spaces between the capsules for the fluid to flow therethrough when the capsules are held in bulk within the containers 12, 14. This is particularly advantageous to have homogeneous heat transfer properties within the containers (constant airflow, constant air velocity, uniform convection coefficients, controllable temperature gradients within the container, etc.). By fully containing the PCM in individual capsules, there is no need to provide fluid tight conduits and sealed connections between the containers. This allows to use open conveyors or other porous structures for transferring the PCM capsules 16 between the containers 12, 14. In this way, simple and cost effective transfer mechanisms can be used to displace the PCM and that irrespective of its current state (liquid or solid). In other words, the liquid or solid state of the PCM is not a constraint to the transfer of the PCM between the environments E1 and E2.

Figure 2:
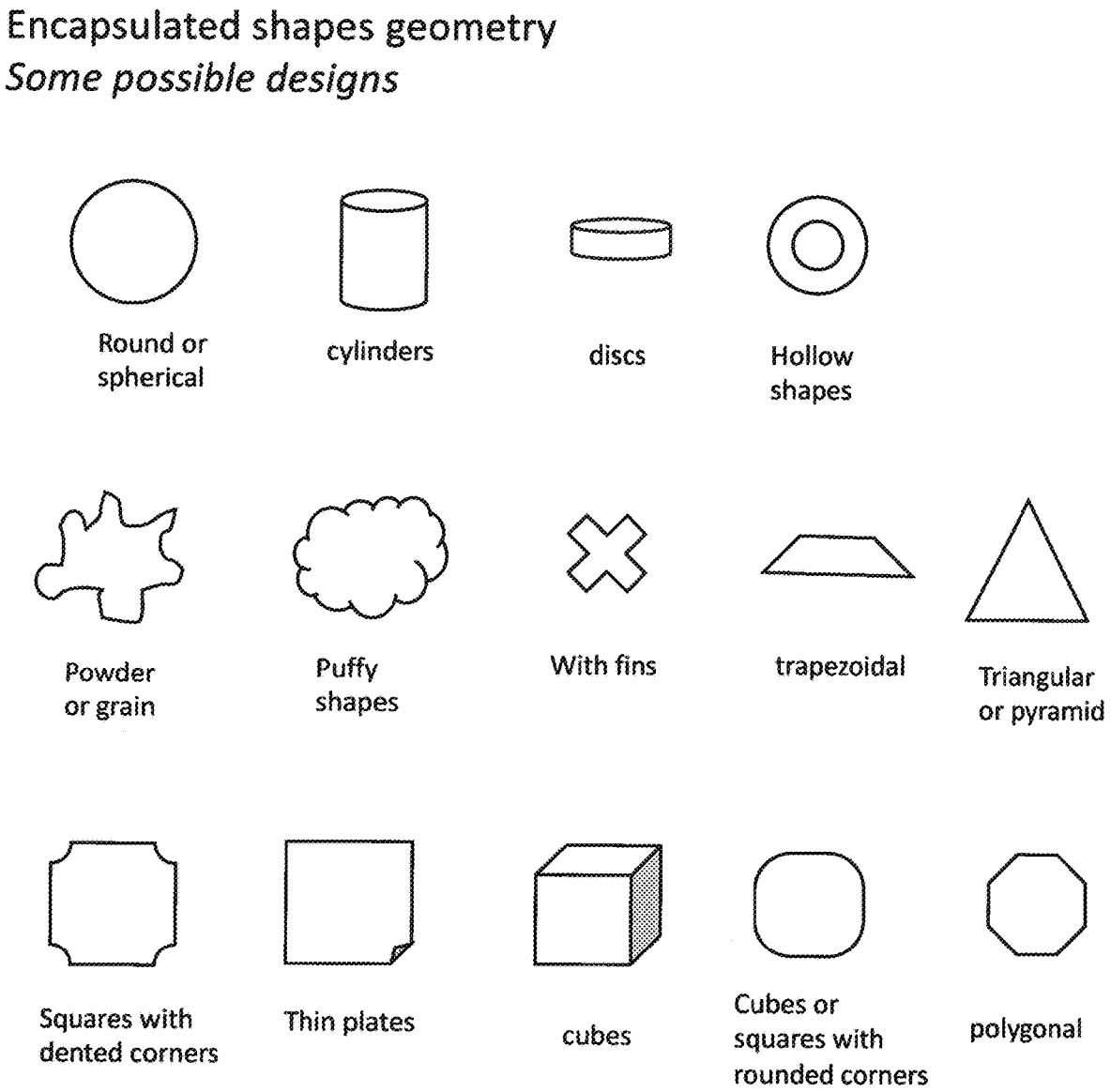
FIG. 2 illustrates various possible geometries of the PCM capsules.

It is understood that the capsule can adopt various shapes other than spherical, provided the PCM capsules 16 can be moved/conveyed from one container to another and allow for around the individual capsules. FIG. 2 illustrates some possible shapes/configurations of the PCM capsules: cubes, cylinders, star-shaped pieces, disc, including micro-encapsulation (in the form powder) just to name a few. Any designs or shapes allowing the encapsulated PCM to be easily transported from one container to the next, while allowing to store a sufficient amount of thermal energy is herein contemplated. There is also the possibility of micro-encapsulation, in which the finished product is provided in the form of a powder or a granular material.

The transfer mechanism 18 can take the form of any transfer means suitable to physically transfer/convey the encapsulated PCM units 16 between the containers 12, 14. For instance, the transfer mechanism 18 could include mechanical transfer apparatuses, such as endless screws, pneumatic air tubes, conveyor belts, etc. According to the example illustrated in FIG. 1, the transfer mechanism 18 comprises a first endless screw conveyor 24 having a bottom intake end 24*a* and a top discharged end 24*b*. The bottom intake end 24*a* is disposed to receive PCM units/capsules 16 from a gravity chute 26 provided at the bottom end of the first container 12. The top discharged end 24*b* of the first endless screw conveyor 24 communicates with a top end of the second container 14 via a first discharged pipe 28. The first discharged pipe 28 slopes downwardly from the top discharged end 24*b* of the first endless screw conveyor 24 to an inlet opening defined at a top end of the second container 14. In this way, PCM units/capsules 16 can be transferred from the bottom of the first container 12 to the top of the second container 14.

The transfer mechanism 18 further comprises a second endless screw conveyor (or other means of capsule transfer) 30 having a bottom intake end 30*a* and a top discharged end 30*b*. The bottom intake end 30*a* of the second screw conveyor 30 is disposed to receive PCM units/capsules 16 from a gravity chute 32 provided at the bottom end of the second container 14. The top discharged end 30*b* of the second endless screw conveyor 30 communicates with a top end of the first container 12 via a second discharge pipe 34. The second discharge pipe 34 slopes downwardly from the top discharged end 30*b* of the second endless screw conveyor 30 to an opening defined at a top end of the first container 12. In this way, PCM units/capsules 16 can be transferred from the bottom of the second container 14 to the top of the first container 12.

The controller can be operatively connected to the first and second conveyors 24, 30 to control the flow rate of the PCM capsules 16 from one container to the other as a function of the temperature and fluid flow (e.g., air flow) in the warm environment (heat charge cycle of the system) and the temperature and fluid flow in the cold environment (heat discharge cycle of the system). As mentioned above, the controller may be operatively connected to sensors for measuring various parameters (flow rate, temperature, pressure, etc.) of the fluid flow through the first and second containers. Signals received from the sensors are computed by the controller to generate control commands to the various actuable components of the first and second fluid circuits and to the transfer mechanism of the PCM capsules.

Depending on operational factors and set points, the rate at which the PCM capsules 16 are moved from one container to the other is variable. In some embodiments, the rate of transfer is determined by factors such as: 1) air cooling or heating power required by end-user; 2) availability of cool source; and 3) availability of heat source: if the heat source on the outside varies through a given period (for instance in the case of solar air collectors), the PCM will melt more quickly. That being, for heating applications, the closer the incoming temperature (overshoot) is to the PCM melting temperature, the better. Same with cooling: the closer the nighttime temperature (undershoot) to the solidifying temperature of the PCM, the better (in terms of energy efficiency). In the real world, the lower the temperature differential (positive or negative), the more the use of free, diurnal to nocturnal temperature differences, can be used to the user's advantage.

FIG. 3 illustrates one possible application for the above-described system. According to this application, the first container 12 is disposed outdoor adjacent a building wall, whereas the second container 14 is disposed indoor inside an enclosed space (e.g., a room inside the building) to be heated or cooled. In the heating mode, the warm PCM capsules 16 (filled with melted PCM) will be travelling from the outdoor container 12 to the indoor container 14, and the cold PCM capsules 16 (with solid PCM) will be traveling from the indoor container 14 to the outdoor container 12. In the cooling mode, the warm PCM capsules 16 (filled with melted PCM) will be travelling from the indoor container 14 to the outdoor container 12, and the cold PCM capsules (with solid PCM) will be traveling from the outdoor container 12 to the indoor container 14. Since both containers are at equal pressure, there is no need for a compressor. This is advantageous relative to traditional heat pump systems. Depending on the need for air heating or cooling in the indoor space, the flow of PCM capsules 16 may start from a reservoir of melted capsules or from a reservoir of solid capsules into the heating/cooling containers 12 or 14.

Figures 10A, 10B:
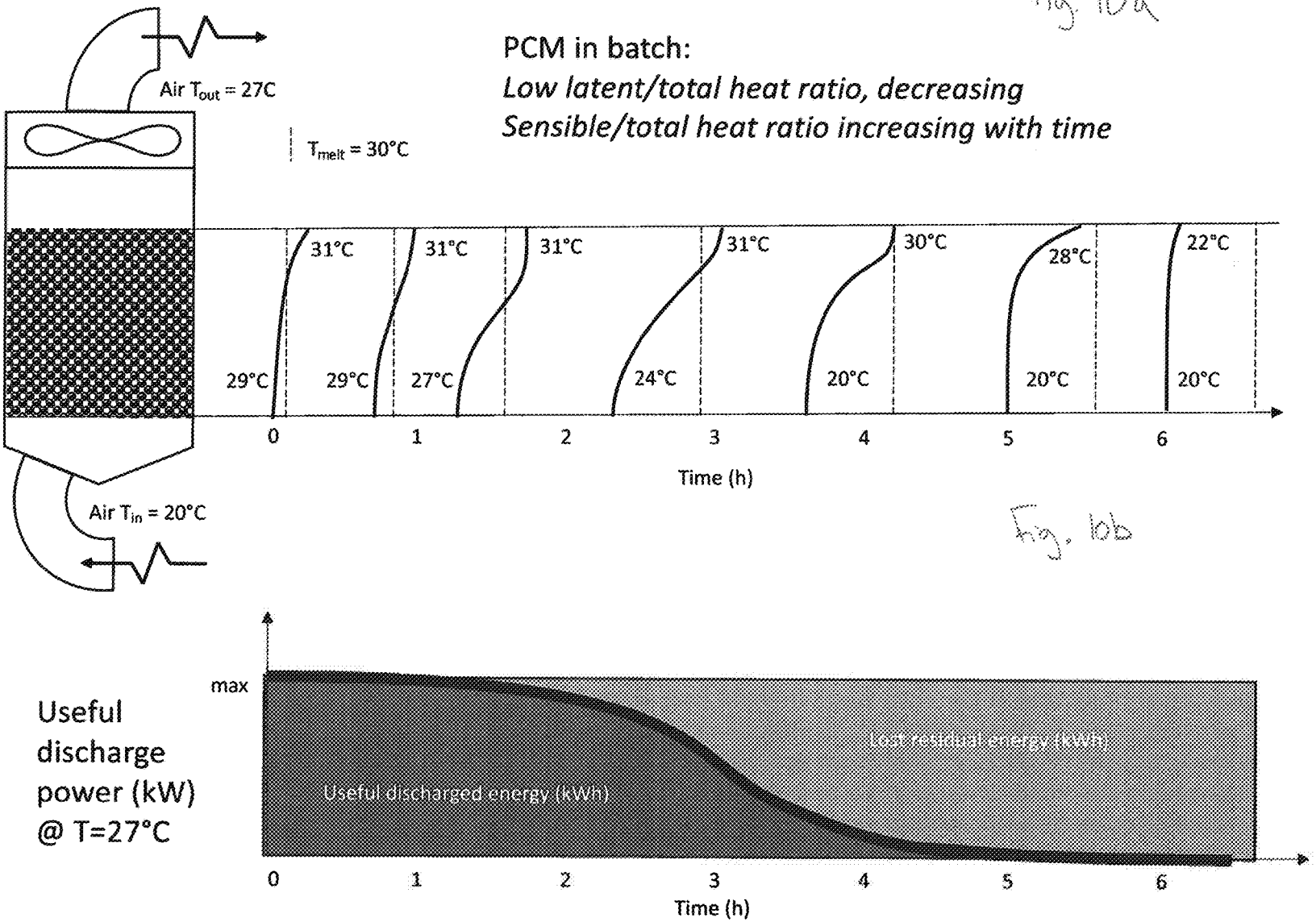
FIGS. 10*a* and 10*b* illustrate the variation of the useful discharge power overtime in a stationary batch system including a latent heat phase and a sensible heat phase.
Figure 11A:
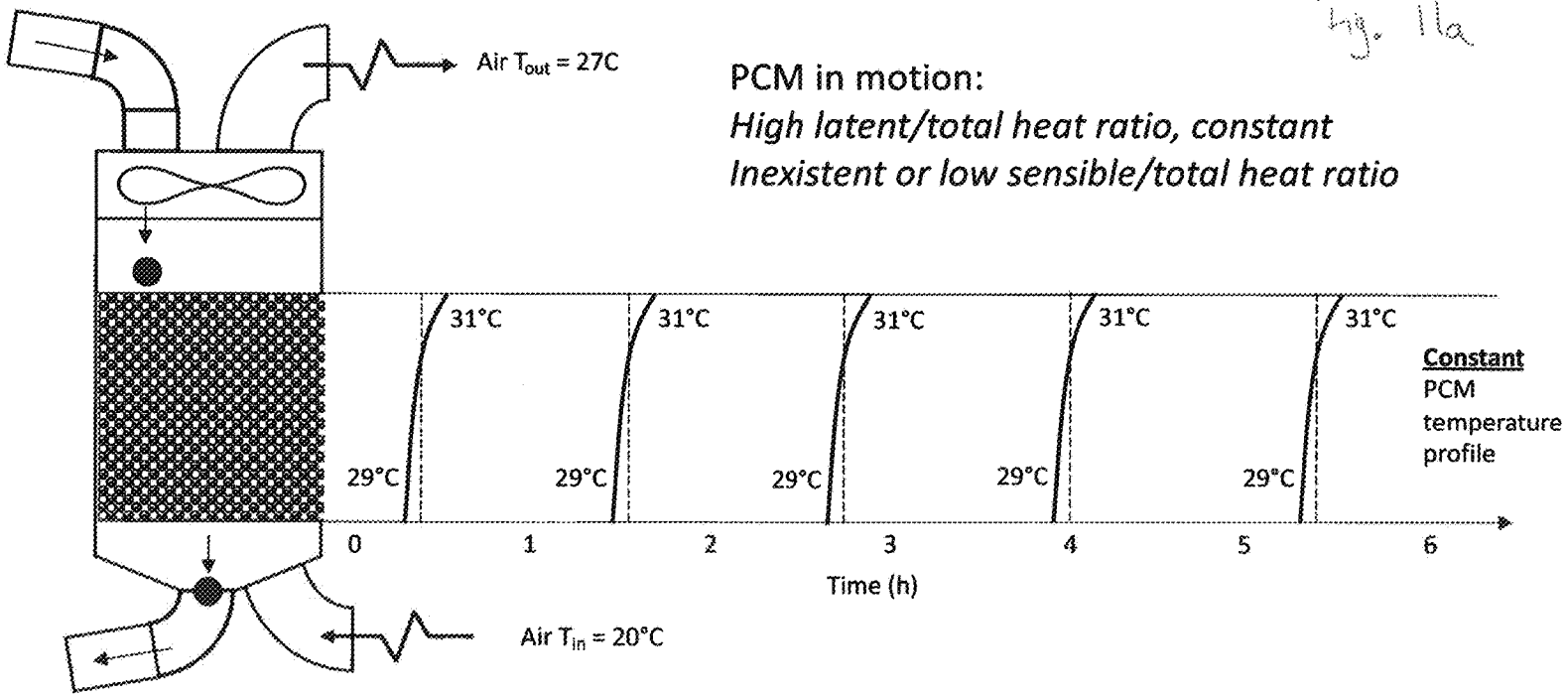
FIGS. 11*a* and 11*b* illustrate the useful discharge power available overtime in a dynamic system maintained in the heat latent phase via a controlled supply and discharge of PCM capsules.
Figure 11B:
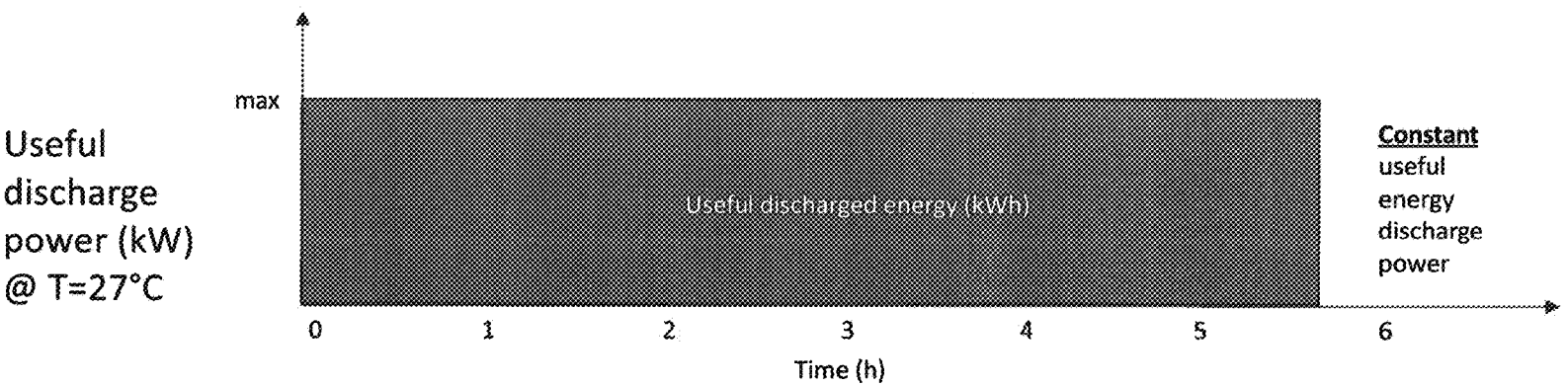

In operation, one of the objectives is to remain within the phase-change/latent heat state of heat transfer, which will yield greater outputs and efficiency values than for conventional batch/immovable systems where the PCM remains stationary in a given environment. As can be appreciated from FIGS. 10*a* and 10*b*, in conventional batch systems where the PCM remains stationary, the useful discharge power decreases overtime as the PCM complete its phase change. The useful power discharge is at its maximum at the beginning of the cycle while the PCM phase transition occurs (latent heat). However, as the transition progress to its completion, the low latent/total heat ratio decreases and the sensible/total heat ratio increases. Ultimately, after the phase change transition has been completed and all the sensible heat capacity has been exhausted, the PCM no longer provides any useful heat transfer energy. In contrast, as shown in FIGS. 11*a* and 11*b*, by setting the PCM in motion to provide a regulated feed and discharge of PCM capsules, it is possible to remain in the latent phase where the phase transition occurs (i.e., where heat transfer energy is maximal). In this way, the useful energy discharge power can remain high and constant overtime. It provides for a high and constant latent/total heat ratio. The sensible/total heat ratio is inexistent or low. By so continuously renewing the PCM capsules, the system can remain highly effective over time.

The graphs of FIGS. 4*a*, 4*b*, 5*a* and 5*b* illustrate what happens in continuous or mobile systems as described above versus in a batch system when, over time, the incoming fluid (e.g., air) will extract (i.e. charge cycle) or give off (i.e. discharge cycle) heat to the encapsulated PCM.

As can be appreciated from FIGS. 4*a* and 4*b*, during the charge cycle, the heat transfer fluid (e.g., air) is at first in contact with solid PCM only. When the melting starts, heat from the air is absorbed by the PCM capsules 16. The outgoing air temperature stabilizes slightly above the melting point of the PCM (temperature overshoot) during the latent (melting) phase. Once all melted, the PCM is in liquid form and its temperature will eventually reach a value close to the incoming warm air temperature (the heat reference temperature). One can see on these figures that heat transfer, during phase change from solid to liquid, or liquid to solid, happens at constant temperature (herein referred to as latent heat transfer). Once fully melted or fully solidified, the heat transfer mechanism is done within the same physical phase, that is without physical transformation (either liquid or solid). In these cases, heat transfer is herein referred to as sensible heat transfer).

Referring to the graphs of FIGS. 5*a* and 5*b*, during the discharge cycle, the heat transfer fluid (e.g., air) is at first in contact with liquid PCM only. When the solidifying phase starts, the passing air absorbs heat stored in the PCM. The outgoing air temperature stabilizes slightly below the melting point of the PCM (temperature undershoot during the latent (solidifying) phase. Once all solidified, the PCM is in solid form and its temperature will eventually reach a value close to the incoming cool air temperature (the cool reference temperature). In a batch system, once the PCM is all melted or all solidified, the only heat transfer left is sensible, which means it is rapidly decreasing with changing increasing temperatures. In contrast to conventional static batch systems, the system 10 is dynamic and provides for the transfer of the PCM capsules from one environment to another so that the heat transfer rate between warm and cold sources is done so that the heat transfer happens during the phase-change transformation of the capsule (latent heat transfer).

Heat transfer between the PCM and the surrounding heat transfer fluid (e.g., air) always remains within phase change temperature range, thereby narrowing the gap between melting and fluid temperatures.

Air Conditioning at Low Cost or Energy Input

The output of the present technology will be a heating or cooling effect of the fluid (e.g., air). To achieve that, the above-described system will consume electricity for moving the PCM capsules from one container to the other, and to move the fluid within each container. According to some applications, the thermal output of the system may be 20 times greater that the electricity input into the system. This ratio of 20 to 1 (20:1) means that the expected coefficient of performance (COP) will be 20 or more. In comparison, most commercially available, conventional heat pumps have a COP of 3, 4 or 5, and at best, up to 8 or 9.

Heating at Low Cost

Preferably, the heat source will be free or, at least, as cheap as possible. For instance, the heat source could consists of: waste heat from a process, exhaust air from a building, air or water-based solar collectors, off-peak electric heat, exothermal composting process, ground-source, or water from rivers and lakes.

Again, in at least some embodiments, a low energy consumption (in the form of electricity) will be required compared to the heat output of the apparatus. For instance, some embodiments may provide a 1:20 ratio range.

By moving/transferring the PCM capsules between the environments/sources, the stock of fully melted or fully solid PCM (where only sensible heat transfer occurs) within the system may be kept to a minimum. Most capsules operate within the phase-change zone (where latent heat transfer occurs). In this way, the ratio latent/total heat transfer may be maximized. This means most heat transfer happens, at any time and at any position with the system, at the lowest possible temperature differential between the heat source and the melting point. This allows for low-temperature heat sources (such as provided by transpired unglazed solar air collectors) to be able to be stored for later use in a helpful manner, for example from daytime low-temperature charging to nigh time slow discharging.

Such a low-temperature differential is not insignificant because:

1) The system will be able to operate at lower temperatures (close to melting point) to melt the PCM, enabling the system to make better use of waste heat, solar-heated air or other heat sources.
2) The system will be able to operate at higher temperatures (close to solidifying temperature point) to solidify the PCM, so that more available cool night air can be exploited as a free source on the cool side.

Figure 6:
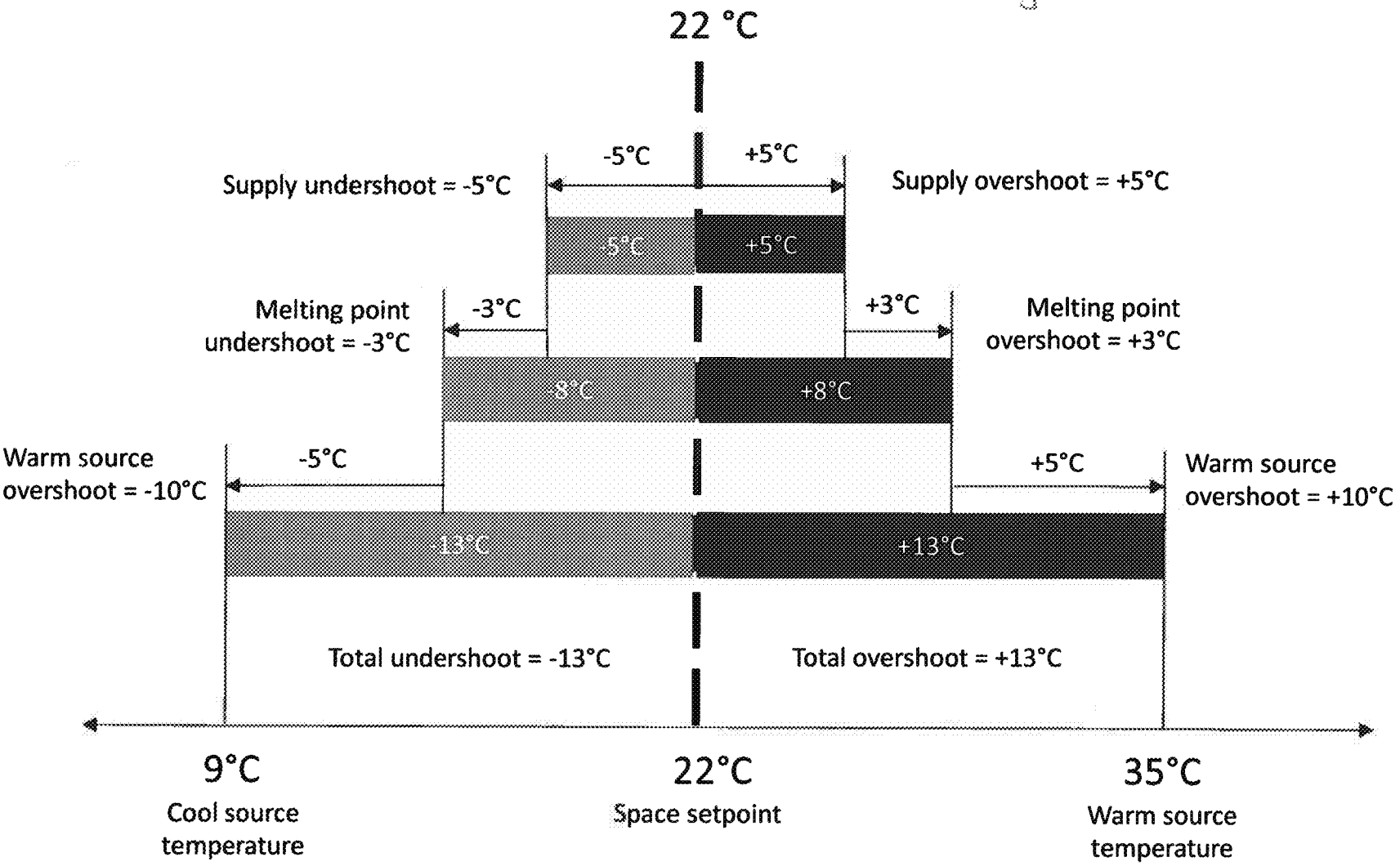
FIG. 6 is a graphic representation illustrating the total temperature overshoot of warm air as heat source and the total temperature undershoot of cold air as coolth source.

Graphically, as can be appreciated from FIG. 6, a smaller temperature differential means:

1) Lower total temperature overshoot of warm air as heat source.
2) Lower total temperature undershoot of cold air as cool source.

The overshoot and undershoot temperatures illustrate the necessary temperature difference between incoming air and melting point required to actually effect latent heat transfer above or below the phase change temperature.

Figure 7:
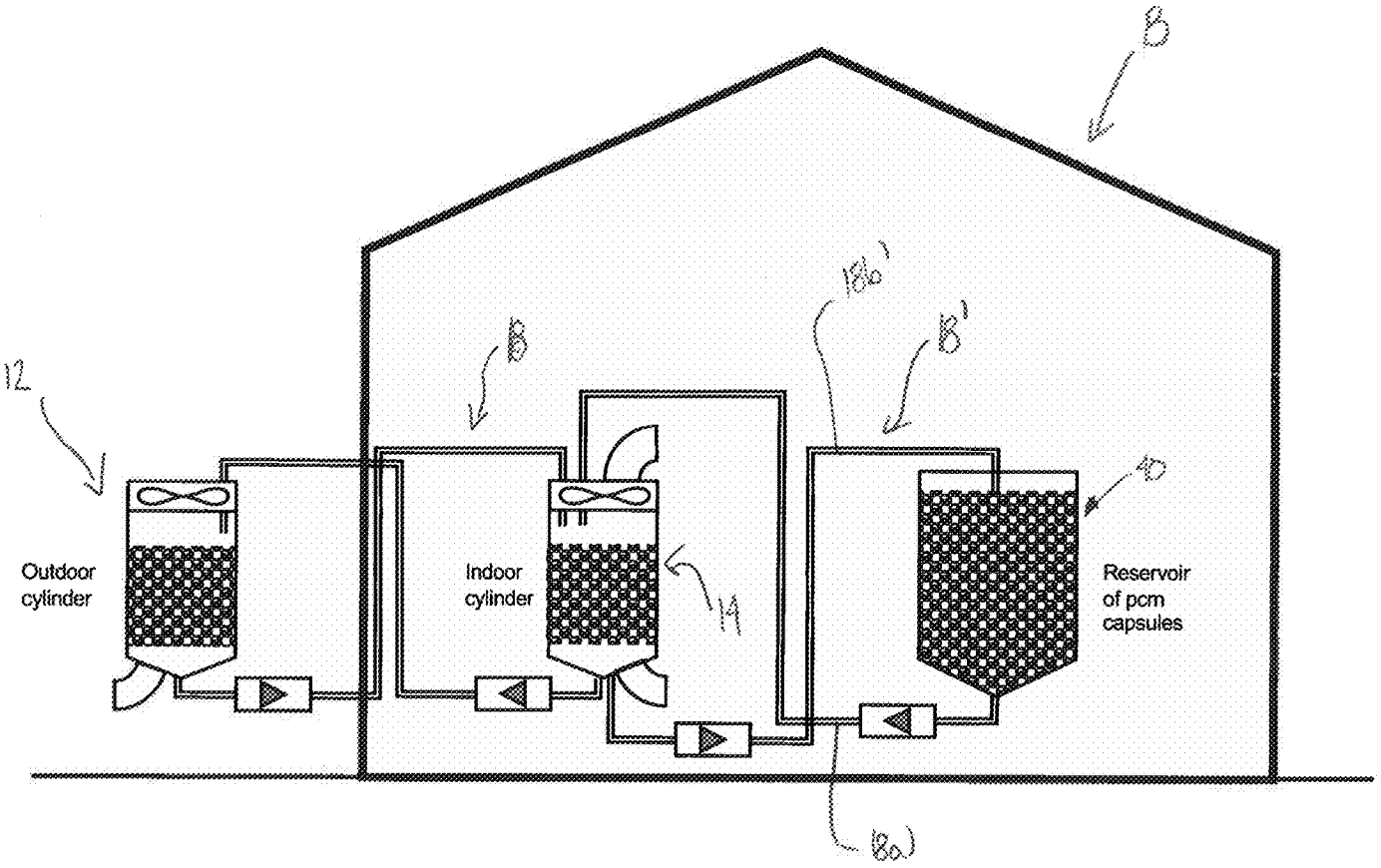
FIG. 7 illustrates an embodiment of the system including a storage reservoir of PCM capsules.

When heat is absorbed during daytime, it can be temporarily stored for later delivery the following evening/night or at any later time when desired. When coolth is absorbed during nighttime, it can be temporarily stored for later delivery the following day or at least following evening/night or at any later time when desired. If a long delay is needed between charging and discharging, there can be storage of the PCM capsules in a buffer container 40 as for instance exemplified in FIG. 7. As shown in FIG. 7, the buffer container 40 can be disposed inside a building B and be operatively connected to the indoor container 14 via an additional transfer apparatus 18'. The additional transfer apparatus 18' can comprise a first line 18*a*' for transferring stored PCM capsules from the buffer container 40 to the indoor container 14 and a second line 18*b*' for transferring PCM capsules from the indoor container 14 to the storage or buffer container 40. Each of the first and second lines 18*a*', 18*b*' can comprise an independently operable conveyor as for instance described herein above with respect to the primary transfer apparatus 18 depicted in FIG. 1. It is understood that the container 40 or other similar capsule storage containers could be similarly connected to the outdoor container 12. In fact, the system may comprise any type of capsule reservoirs so that according to a call for heat or cold of the system, there can be a mechanical flow of encapsulated PCM to the cold or warm containers.

The demand for air conditioning around the world is larger than for heating. The present technology can advantageously be used for air conditioning purposes, particularly in zones where summer nights are cool, such as in dryer climates. Because cool nighttime air can be used to solidify the PCM capsules/units at night, the technology is well suited for use in places where there is a great daytime vs nighttime temperature difference, where hot days are followed by cold nights. Such conditions can be found in drier climates such as the Western US states, the Canadian prairies or the Pacific coast of South America.

Figure 8:
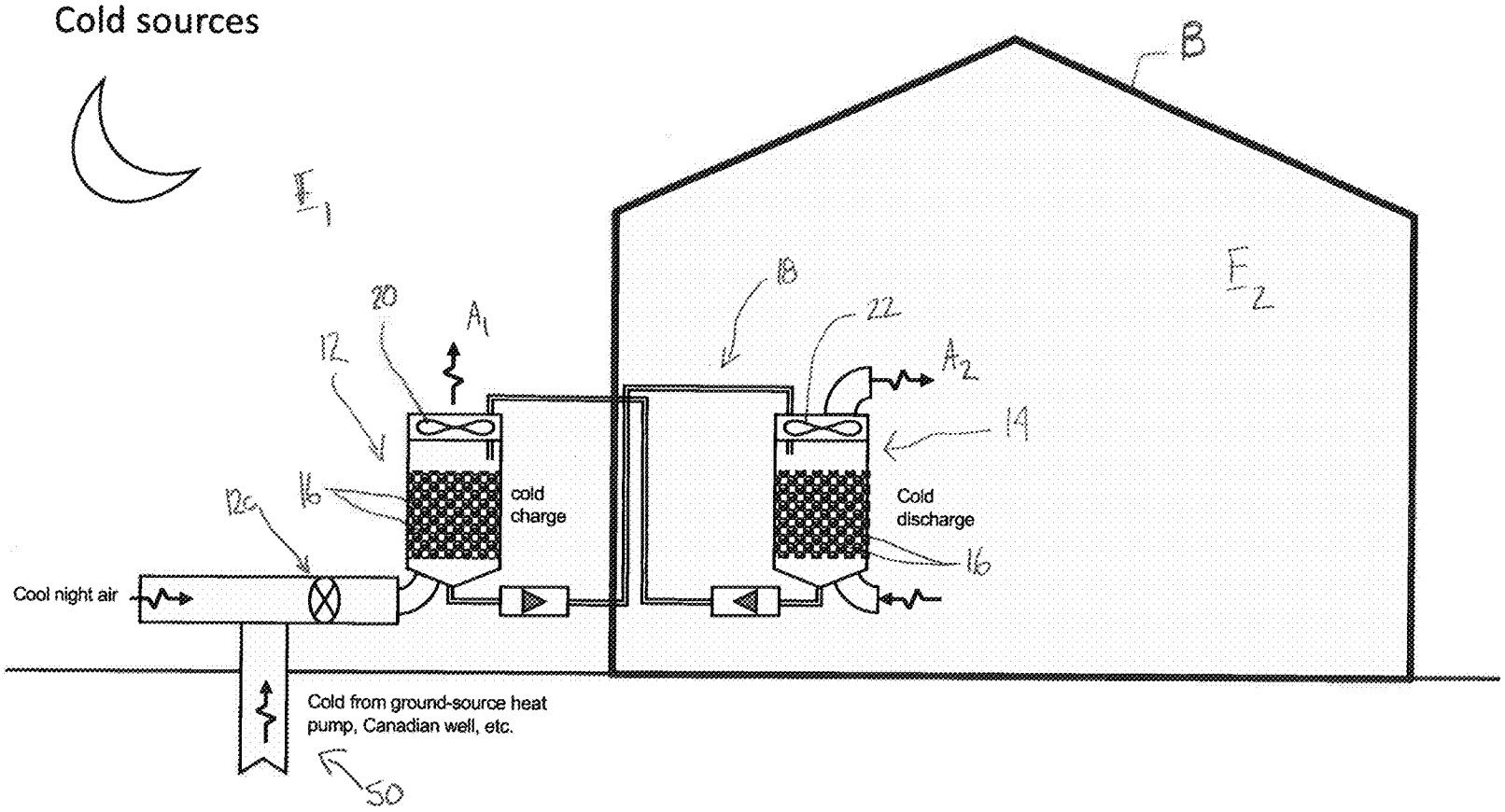
FIG. 8 is a schematic view illustrating various cold sources, but not a comprehensive list, that can be used to cold charge the PCM capsules.

As shown in FIG. 8, nighttime air can be used as a cold source. For instance, nighttime air can be used with the present technology to cool down an interior space of a building B. The ambient cool air A1 can be used alone or in combination with another cold source, such as a cold source 50 from a ground-source heat pump, a well or any other cold storage mass. For instance, cold water could be used as a cold source alone or together with cold air to cold charge the PCM capsules inside the first container 12 during nighttime.

Figure 9:
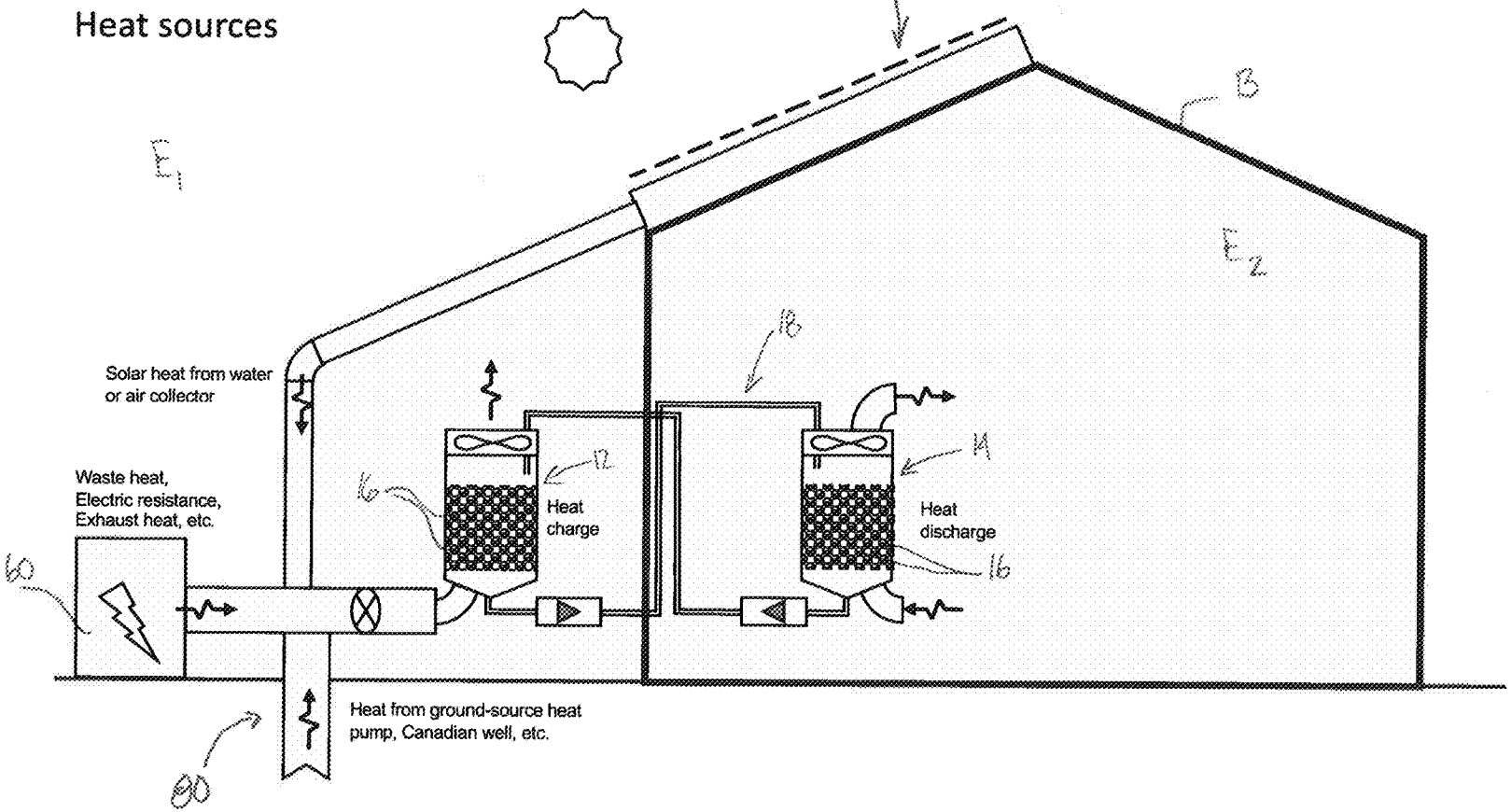
FIG. 9 is a schematic view illustrating various hot sources, but not a comprehensive list, that can be used to heat charge the PCM capsules.

Referring to FIG. 9, it can be appreciated that various heat sources could be used alone or in combination to heat charge, the PCM capsules 16 inside the first container 12. For instance, any waste heat source 60 from an exhaust fan, process chimney, electric resistance, etc. could be used to pre-heat the ambient air prior to the air being circulated in between the PCM capsules 16 inside the first container 12. Solar water or air heating collectors 70 could also be used as a primary or complementary heat source. Heat sources 80 from the ground, such as Canadian well or geothermal pits could be used as well. Any other suitable heat source, such as off-peak electric heat generation are contemplated as well.

The various embodiments of the system 10 may be configured and sized for one-day cycle:

deliver daytime heat at night; and deliver nighttime coolth during the day.

Alternatively, the system may be configured and sized for much later use, for example in seasonal storage, that is:

deliver summer heat in winter;

deliver winter coolth in summer.

Thermal masses not filled with PCM, that is thermal masses with sensible heat storage only, could be used together with the PCM capsules 16. For instance, rocks, bricks, metal bullets, etc. in the solid-only phase; water, glycol solution, refrigerant, anti-freeze mix, etc., in the liquid-phase only could be used in combination with the encapsulated PCM.

It can be appreciated from the present disclosure that the system 10 allows to actively renew the PCM capsules within one container with new capsules that are not at the same state, thereby allowing improving heat transfer. This may be accomplished by setting the PCM capsules in motion between environments that are different temperatures. It provides for a dynamic system, where the PCM capsules are transferred/moved so that the bulk of the capsules subject to heat charge or heat discharge are in the process of changing from a solid state to a liquid state and from a liquid state to a solid state, respectively (i.e. the PCM is in its latent state). Advantageously, unlike conventional heat pumps, the system operates without the need for a compressor since the cold side and the hot side of the system generally operate at the same pressure (e.g., the atmospheric pressure).

It can be appreciated that at least some of the contemplated embodiments allow cooling or heating an enclosed space or process without having to resort to the combustion of any fossil fuel, thereby making them more environmentally friendly. Indeed, electrical energy may be used to 1) convey the PCM units between the containers with mechanical means and/or gravity, and to 2) move the air (or maybe in some cases water) through the PCM in each container with mechanical fans or pumps. It is noted that the electricity may come from the grid, but also from other sources such photovoltaic panels, making the system in this case operate fully off the electrical grid. It can thus be appreciated that at least some embodiments provide for a low energy input vs high thermal output, thereby providing for an efficient heating and cooling system with COP values that have not so far been reached with refrigerant-charged systems, such as traditional heat pumps The embodiments described in this document provide non-limiting examples of possible implementations of the present technology. Upon review of the present disclosure, a person of ordinary skill in the art will recognize that changes may be made to the embodiments described herein without departing from the scope of the present technology. Any modifications that could be implemented by a person of ordinary skill in the art in view of the present disclosure would be within the scope of the present technology.

The invention claimed is:

1. A heat transfer system comprising:

a first container and a second container, the first container located in a first environment, the second container located in a second environment, the first environment having a first temperature, the second environment having a second temperature, the first and second temperatures being different, the first and second containers each containing a plurality of capsules having a phase change material (PCM) core encapsulated in a thermally conductive outer shell, the PCM core having a phase change temperature selected between the first and second temperatures;

a first fluid circuit for circulating a first fluid in heat exchange relationship with the plurality of capsules inside the first container;

a second fluid circuit for circulating a second fluid in heat exchange relationship with the plurality of capsules inside the second container;

transfer means having a first transfer line for transferring the plurality of capsules from the first container to the second container and a second transfer line for transferring the plurality of capsules from the second container to the first container; and a controller operatively connected to the transfer means and the first and second fluid circuits, the controller configured for controlling a flow rate of the plurality of capsules between the first and the second containers as a function of a temperature and a flow rate of the first fluid through the first container and a temperature and a flow rate of the second fluid through the second container.

2. The heat transfer system according to claim 1, wherein the controller is configured to operate the transfer means so that heat transfer between the first and second fluids and the plurality of capsules occurs during a phase-change transformation of the capsules.

3. The heat transfer system according to claim 1, wherein an entirety of a PCM circulated between the first and second containers is encapsulated, wherein the PCM core of the plurality of capsules is configured to transition from a liquid phase to a solid phase, and wherein the transfer means are operable to move the plurality of capsules between the first and second containers in both the liquid phase and the solid phase of the PCM core.

4. The heat transfer system according to claim 1, wherein a first pressure inside the first container is equal to a second pressure inside the second container.

5. The heat transfer system according to claim 1, wherein the first container is an outdoor container and the second container is an indoor container.

6. The heat transfer system according to claim 1, wherein the first fluid is air, wherein the first container has a first air inlet and a first air outlet, wherein the second fluid is air, wherein the second container has a second air inlet and a second air outlet, and wherein the first fluid circuit and the second fluid circuit are respectively provided with a first air mover and a second air mover to cause a first air flow from the first air inlet to the first air outlet and a second air flow from the second air inlet to the second air outlet.

7. The heat transfer system according to claim 1, wherein the first transfer line of the transfer means includes a first conveyor for transferring the plurality of capsules from the first container to the second container, and wherein the second transfer line has a second conveyor for transferring the plurality of capsules from the second container back into the first container.

8. The heat transfer system according to claim 1, further comprising a third container for storing additional PCM capsules, the third container operatively connected to one or more of the first and second containers for transferring stored PCM capsules from the third container to the one or more of the first and second containers and vice versa.

9. The heat transfer system according to claim 8, wherein additional transfer means are provided to move the additional PCM capsules between the third container and the one or more of the first and second containers.

10. The heat transfer system according to claim 1, wherein each of the plurality of capsules has a spherical shape.

11. A heat transfer system comprising:

an outdoor container disposed outside of a building;

an indoor container remote from the outdoor container and disposed inside an enclosed space of the building;

a solid-liquid phase change material (PCM) having a phase change temperature selected between a first temperature of the outdoor container and a second temperature of the indoor container, an entirety of the PCM encapsulated in individual capsules;

a transfer mechanism having a first transfer line for transferring the individual capsules from the outdoor container to the indoor container and a second transfer line for transferring the individual capsules from the indoor container to the outdoor container;

a first heat transfer fluid circuit for directing a first heat transfer fluid through the first outdoor container, the first heat transfer fluid in heat exchange relationship with the individual capsules inside the outdoor container;

a second heat transfer fluid circuit for directing a second heat transfer fluid through the indoor container, the second heat transfer fluid in heat exchange relationship with the individual capsules inside the indoor container; and a storage container for storing a portion of the individual capsules, the storage container operatively connected to one or more of the outdoor and indoor containers to allow transfer of the portion of the individual capsules from the storage container to the one or more of the outdoor and indoor containers and vice versa, wherein the storage container is disposed in the enclosed space together with the indoor container.

12. The heat transfer system according to claim 11, wherein the transfer mechanism is configured to transfer the individual capsules at a rate selected to maintain the PCM in a heat latent phase.

13. The heat transfer system according to claim 11, wherein the first heat transfer fluid circuit comprises a first air inlet at a bottom end of the outdoor container, a first air outlet at a top end of the outdoor container, and a first air mover for causing a first flow of air from the first air inlet to the first air outlet, and wherein the individual capsules are received in bulk inside the first outdoor container between the first air inlet and the firs air outlet.

14. The heat transfer system according to claim 13, wherein the second transfer line of the transfer mechanism comprises a first discharge pipe at the top end of the outdoor container for discharging the individual capsules into the first outdoor container in a direction opposite to the first flow of air though the first outdoor container.

15. The heat transfer system according to claim 14, wherein the first transfer line of the transfer mechanism-further comprises a first gravity chute at the bottom end of the first outdoor container for discharging the individual capsules from the first outdoor container.

16. The heat transfer system according to claim 15, wherein the first transfer line of the transfer mechanism comprises a first conveyor having a bottom end connected to the first gravity chute for receiving individual capsules from the bottom end of the outdoor container and an upper end connected to a second discharge pipe for discharging the individual capsule into a top end of the indoor container.

17. The heat transfer system according to claim 15, wherein the second transfer line of the transfer mechanism further comprises a second gravity chute at a bottom end of the indoor container.

18. The heat transfer system according to claim 17, wherein the second transfer line of the transfer mechanism further comprises a second conveyor having a bottom end connected to the second gravity chute and a top end connected to the first discharge pipe.

* * * * *